United States Patent [19]

Forsberg

[11] 4,266,902

[45] May 12, 1981

[54] TRANSPORT CONTAINER

[76] Inventor: Georg L. K. Forsberg, Nylandsgatan 14, 654 65 Karlstad, Sweden

[21] Appl. No.: 38,905

[22] Filed: May 14, 1979

[30] Foreign Application Priority Data

May 19, 1978 [SE] Sweden ..... 7805744

[51] Int. Cl.[3] ..... B65G 65/46

[52] U.S. Cl. ..... 414/332; 198/658; 198/671; 414/298; 414/301; 414/326; 414/416

[58] Field of Search ..... 414/287, 298, 300, 301, 414/326, 416, 417, 468, 526, 332; 198/558, 658, 671

[56] References Cited

U.S. PATENT DOCUMENTS 3,774,792 11/1973 Willmroth ..... 414/417

FOREIGN PATENT DOCUMENTS 1761831 12/1974 Fed. Rep. of Germany .

70254 3/1959 France .

*Primary Examiner*—Jeffrey V. Nase

*Attorney, Agent, or Firm*—Murray and Whisenhunt

[57] ABSTRACT

A transport container of conventional parallelepiped form is disclosed, wherein the container includes a perforated drum and a worm conveyor inside of the drum for loading and discharging bulk material into and out of the container. The drum and the worm conveyor are rotated in opposite directions, and are positioned in one of the corners of the container extending from one gable of the container to the other. The drum and worm conveyor permit the container to be completely and evenly filled with a bulk material, or completely emptied, without substantial dust formation. During loading operation the corner in which the drum and worm conveyor are located is turned upwards, and during discharge operation the same corner is turned downward.

7 Claims, 4 Drawing Figures

Figure 1:
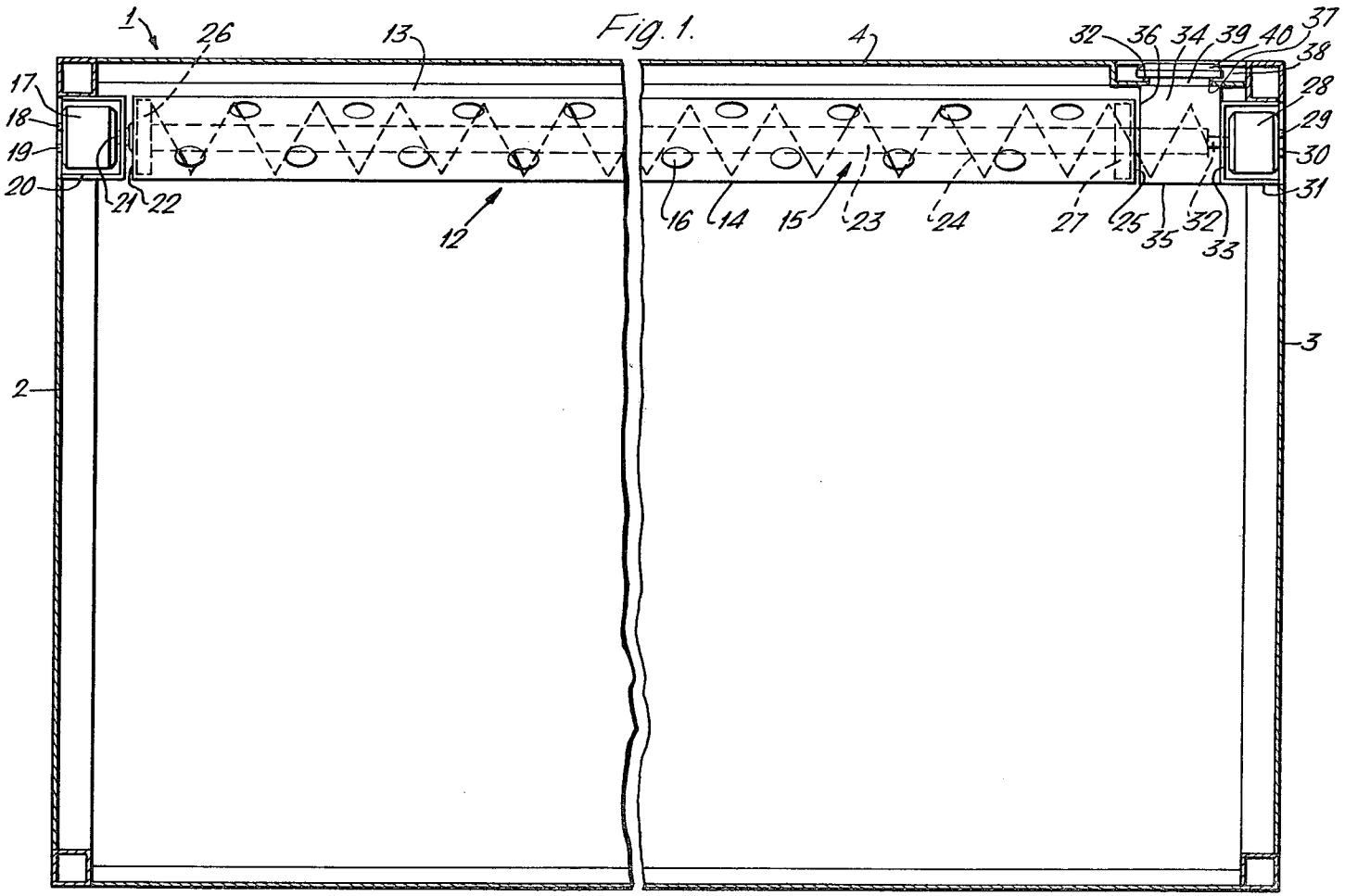

10
1
6
7
9
3
11
D
5
4
28
39
41'
44'
41'
43
8
42'

TRANSPORT CONTAINER

The present invention relates to a substantially parallel epipedically formed container intended for the transportation of bulk products such as granules, bead products, powder and similar bulk cargos. More particularly the invention relates to a container with means for loading and for discharging the container.

Containers are used to a large extent for the transportation of bulk products such as granules, beads, powder and similar bulk cargos. These containers which usually are called bulk containers often are provided with a plastic liner on the inside in order to facilitate the cleaning of the container after discharging. A number of systems are presently used for loading these bulk containers with the bulk products in question. Usually these loading systems have in common that special loading equipments are attached to the gable of the container after the cargo hatch has been opened. The plastic liner then is supported by an underframe on the inside of the hatch. Among used loading equipments may in the first place be mentioned belt conveyors, pneumatic conveyors and conventional worm conveyors. These systems have the drawback that they require the availability of specially designed loading equipments on the loading-point. Another drawback is that the container should be provided with gable hatches and with a plastic liner on the inside as well as with an underframe which supports the plastic liner when the hatches are opened in connection with the loading. Another drawback is that it is difficult to fill the container evenly and completely with previously known loading means, particularly when the container has a considerable length. Still another drawback with known systems is that special means often are required for the discharging of the container. Usually, however, some type of tipping method is used. In the most simple case the cargo is tipped directly into a vertical chute or the like through the rear opening of the container. This however often gives off dust or may cause other inconveniences. Therefore it is preferred instead to use pneumatic systems which, however, require special arrangements not only for the receipt of the cargo but also for feeding the material out of the container into the pneumatic device in order to obtain a complete and controlled discharge operation.

These and other drawbacks can be eliminated through the invention which is characterized by the accompanying claims.

It is herein a first object of the invention to provide the container with means arranged for the twofold function of on one hand to load and on the other hand to discharge the bulk products into and out of, respectively, the container such that special loading and discharging devices are eliminated.

Another object is that said means shall be able to distribute the bulk products evenly to a substantially complete filling of the container even when the container has a considerable length, and even to be able to evenly and substantially completely discharge the container.

Still another object is that said means shall be able to load and discharge the container substantially without dusting in those cases when the bulk products are easily dust producing.

Further it is an object that said means shall be able to be applied as well in containers of the kind which are provided with an inner plastic lining as in such containers which do not have such lining.

It is also an object that gable hatches on the container shall not be necessary for the loading and discharging of the container.

Further it is an object to provide a container with means for loading and discharging the container, which means can be provided more or less permanently in the container and which do not project beyond the external contour of the container in order that the dimensions of the container shall not be exceeded, wherein said means can be kept in the container during the transportation as well when the container is filled as when it is empty.

Another object is to provide a container with combined loading and discharging means, which means can be driven hydraulically with hydraulic motors which can be sunk into the gables of the container, or be driven by motors which are not integrated with the container via transmission means sunk into the gables.

Another object is to provide a container with combined loading and discharging means which extend substantially from one gable of the container to the other and which can be kept in the loaded container without considerably stealing loading space.

It is also an object of the invention to provide a system which is very reliable in service, very easy to operate and which can be used for most different kinds of bulk products substantially irrespective of whether these products are heavy or light, fine grained or coarse, dust forming or not dust forming, moist or dry.

Figure 2:
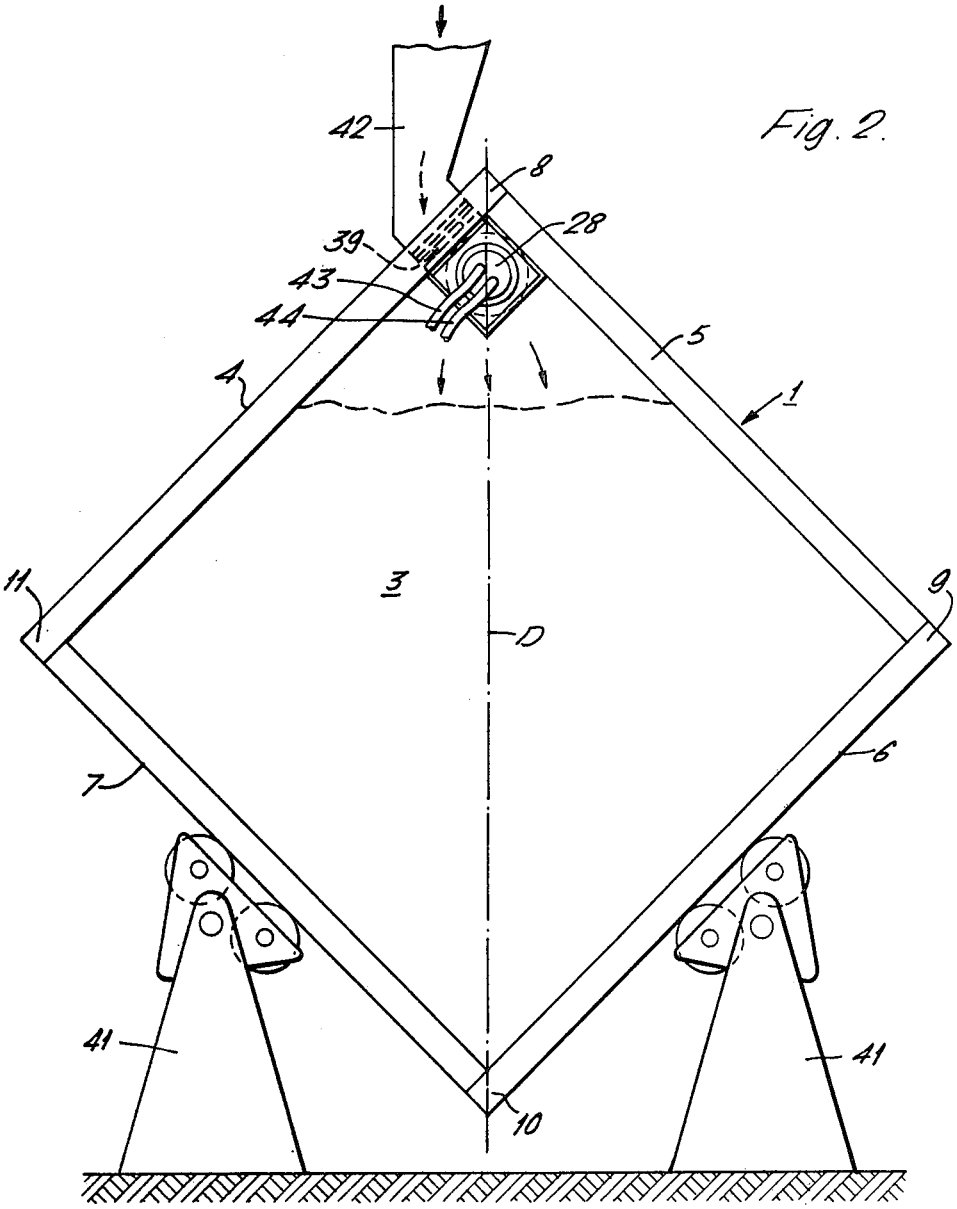
Figure 3:
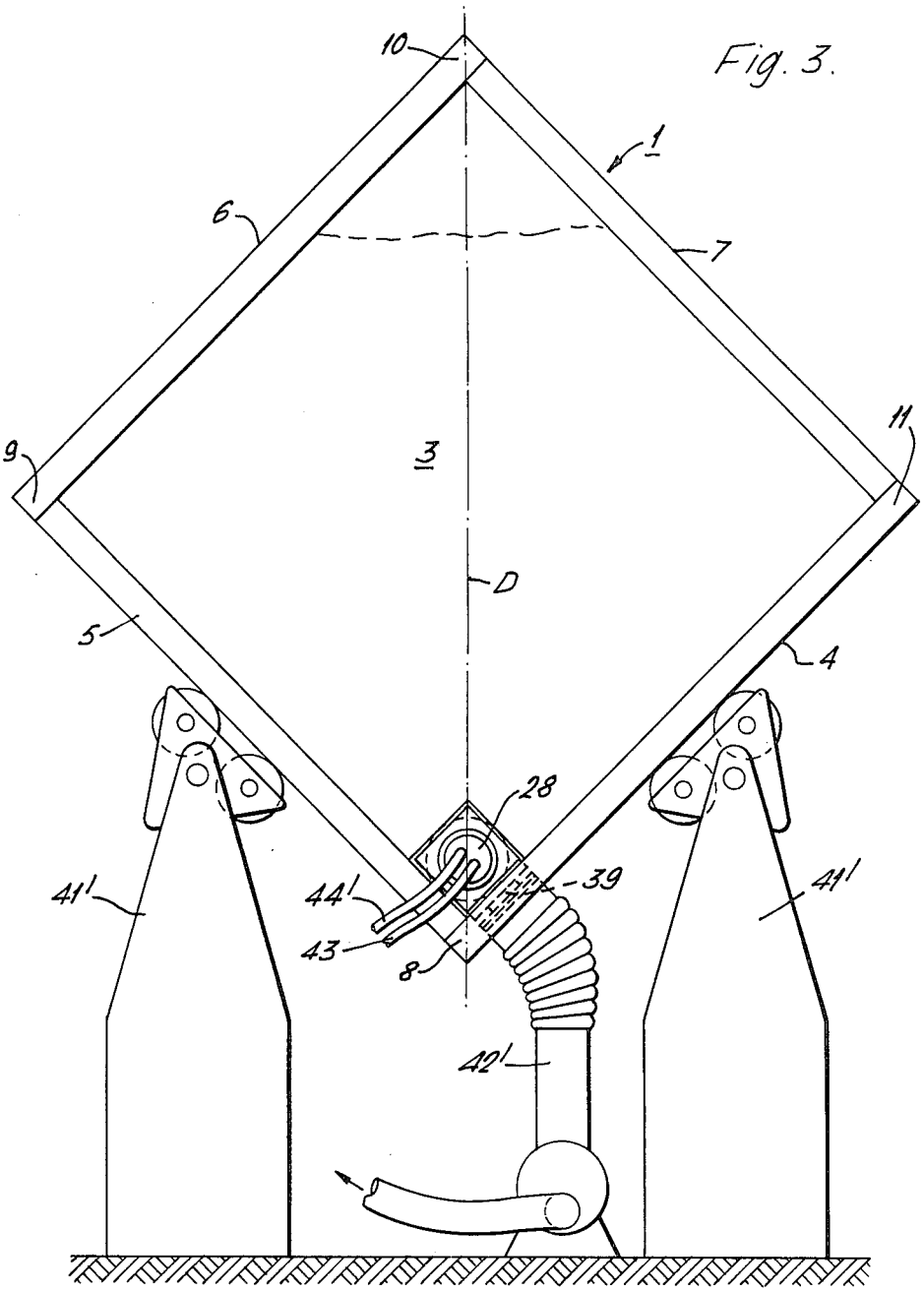
Figure 4:
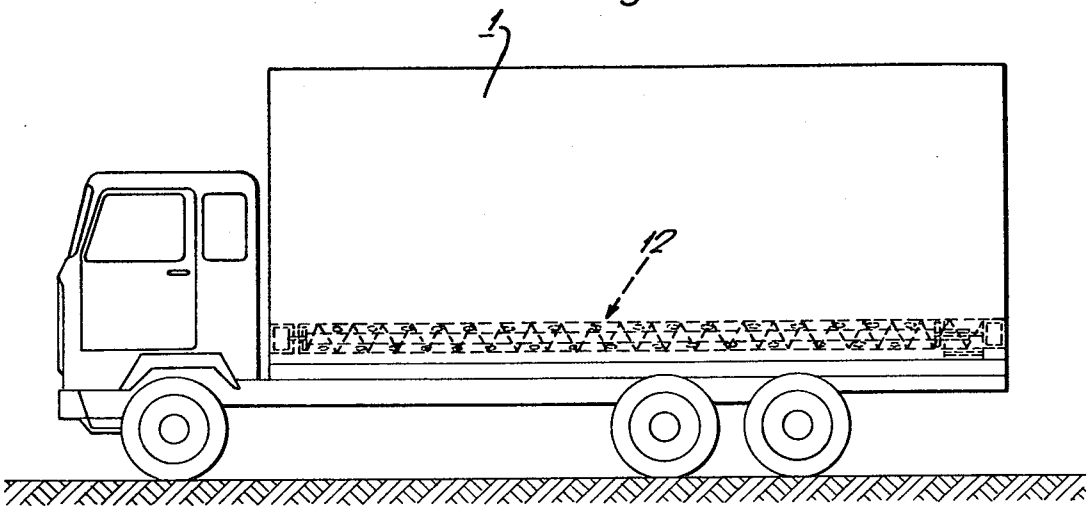

Other objects and advantages of the invention will be apparent from the following description of a preferred embodiment. Herein it will be referred to the accompanying drawings, in which FIG. 1 is a vertical longitudinal section through a container according to the invention, FIG. 2 illustrates the principle of the container through a view towards one gable of the container, corresponding to the right hand gable in FIG. 1, FIG. 3 shows through a corresponding view the discharging of the container, and FIG. 4 shows through a side view a heavy lorry with a container according to the invention in normal transport position.

Referring to the drawings a bulk container is generally shown as 1. The container 1 has a parallel epipedic form and hence has a front and a rear gable 2 and 3, respectively, and four length sides 4, 5, 6 and 7. According to the embodiment the container has a square section, but the invention is not limited to this form even though it is a standard form for containers. The four longitudinal corners of the container have been designated 8, 9, 10 and 11.

Inside the container 1 in the region of one of the four longitudinal corners, the corner 8, there is provided a so-called tube-feeder 12 extending substantially from the front gable 2 of the container to the rear gable 3. Tube-feeder 12 is parallel with the length sides of the container and is spaced from the two length sides 4, 5 which meet in corner 8 only through a narrow gap. The gap between the tube-feeder 12 and the wall 4 has been designated 13. An equally narrow gap is provided between the tube-feeder 12 and the wall 5, which means that the tube-feeder 12 is symmetrically arranged in container 1 in the region of corner 8 with the axis of the tube-feeder coinciding with a diagonal plan D of the container between corners 8 and 10.

The tube-feeder 12 consists of a cylindrical drum 14 with circular section and containing a concentrically provided worm conveyor 15. The drum 14 has a great number of openings 16 which are evenly distributed along the entire length of drum 14. The drum 14 can be rotated by means of a hydraulic motor 17 which is recessed in the front gable 2 of the container. Hydraulic conduit connections have been shown as 18 and 19, FIG. 1. For the mounting of the hydraulic motor 17 in gable 2 there is provided a motor house 20 recessed in gable 2. The driving shaft of the hydraulic motor 17 has been shown as 21. The driving shaft 21 extends through the inner wall of the motor house and is united with a front gable 22 on drum 14.

The worm conveyor 15 consists of a shaft 23 and a screw blade 24 attached thereto. The worm conveyor 15 extends from the front gable 22 of drum 14 and beyond the rear, open end 25 of drum 14. Further the worm conveyor 15 is mounted in the drum 14 through a support bearing 26 inside the front gable 22 of the drum and through a support bearing 27 inside the rear, open end 25 of the drum. Further, when necessary, particularly when the container 1 and hence the tube-feeder 12 has a considerable length, bearings of the same type as the support bearing 27 can be provided between the two ends of drum 14. The support bearing 27 and possible intermediate bearings are provided with supports designed as propeller blades attached to the inside of the drum and to a journal bearing surrounding the shaft 23 of the worm conveyor 15 such that bulk products can be conveyed without obstacles through the support bearing.

The worm conveyor 15 is provided to be rotated in a direction opposite to that of the drum 14 by means of a hydraulic motor 28 which is recessed in the rear gable 3 of the container. Connections for the hydraulic conduit to motor 28 have been designated 29 and 30. For the mounting of the hydraulic motor 28 in the gable 3 there is in a manner analogous to that for the motor in the front gable provided a motor house 31 recessed in the rear gable 3. The driving shaft 32 of hydraulic motor 28 extends through the inner wall 33 of the motor house 31 and is united with the shaft 23 of the worm conveyor 15.

Between the inner wall of motor house 31 and the rear, open end 25 of drum 14 there is a chamber 34 for the feeding and discharging of bulk products into and out of, respectively, the drum 14. The chamber 34 is separated from the interior of container 1 through walls, roof and bottom. The bottom of the chamber 34 has been designated 35, a front wall 36 and the roof 37. An opening is provided in the front wall 36 corresponding to the shape of drum 14. The roof 37 of chamber 34 coincides with a recessed portion of the outer wall 4 of the container. In the recess 38 formed in wall 4 there is provided a connection 39 to the chamber 34. The connection 39 has been provided with a cover 40 in FIG. 1.

The handling of the container 1 and the operation of tube-feeder 12 during the loading of the container with a bulk material will now be explained with reference to FIG. 1 and 2. Prior to loading the container 1 with a bulk material first cover 40 is removed. Thereafter the container is arranged such that the diagonal plane D extending through the corner 8 in which the tube-feeder 12 is provided will coincide with a vertical plane and with corner 8 turned upwards. Pulley supports 41 can be used for supporting the container 1 which schematically has been illustrated in FIG. 2. For example pulley supports of the type used when welding cylindrical tanks in machine shops may be used. The pulley supports 41 either may be provided with driving means or may separate driving means be provided for turning the container 1 to proper position.

Before starting the loading operation a feeding hopper 42 or other feeding means suitable according to the conditions is connected to connection 39. A pair of hydraulic conduits 43 and 44 are connected to the hydraulic connections 29 and 30 of the hydraulic motor 28. In a corresponding manner hydraulic conduits are connected to connections 18 and 19 of the hydraulic motor 17 on the opposite side of the container. The loading operation thereafter can start. The rear hydraulic motor 28 then rotates the worm conveyor in such a direction that the bulk products which via hopper 42 is fed into chamber 34 successively is fed into drum 14. At the same time the front hydraulic motor 17 rotates the drum 14 in the opposite direction. Herethrough the conveyed products fall out through the openings 16 along the entire length of the drum 14 such that the container is evenly filled with the bulk products without dust formation. Towards the end of the loading operation the container 1 if necessary may be slightly turned to either side in order further to increase the close-packing of the cargo. Eventually the entire container is filled with bulk products including the interior of the drum 14 which thus does not steal load space.

When discharging the container 1 at the point of delivery, FIG. 3, the operation is carried out in an opposite but in other respects analogous manner. The container 1 thus is positioned with corner 8 turned downwards, e.g. on pulley supports 41'. The hydraulic conduits 43' and 44' are connected to the driving motor 28 of the worm conveyor 15 and a not shown hydraulic conduit is connected to the driving motor 17 of drum 14. A discharge hose 42' is coupled to connection 39. The bulk material thereafter can be discharged from the container therein that the worm conveyor 15 and the drum 14 are rotated in directions opposite to the directions during the loading operation. The discharging is performed very evenly and substantially completely without dust formation.

When the container 1 is transported on a vehicle, as is shown in FIG. 4, the container is suitably positioned such that the length side 4 and hence the tube-feeder 12 is turned downwards, wherein it effectively can be protected against damages due to shaking and bumping during transportation. This is true when the container is filled when the tube-feeder 12 is protected by the surrounding bulk material, as when the container is emply when the tube-feeder when necessary can be supported by any simple support which is pressed in under the drum 14.

The invention and what is claimed to be protected is not limited to the described embodiment. A number of modifications of the design thus can be made without departing from the spirit and scope of the invention. Thus other driving means than hydraulic motors can be used for driving the drum and the worm conveyor, e.g. electric motors. It is also possible to mount only couplings in the gable of the container, suitably in the form of splines, in order to be able to connect external driving means, e.g. driving shafts projecting from hydraulic or electric driving units available on the point of loading or discharging. This alternative has that advantage that the equipment of the container may be made at lower costs at the same time as the space in the gables of the container which must be used for the driving means can be reduced. The term "driving means" which is used in this specification and claims therefore shall include also transmission means transferring a driving moment from a driving unit outside the container. Another conceivable modification is to provide the connection 39 to the chamber 34 in the gable 3 instead of in the wall 4.

I claim:

1. A transport container for transportation of bulk products, said container being substantially parallelepipedically formed and having sides, gables and longitudinal corners, tube feeder means for loading and unloading bulk products into and out of said container located in a first longitudinal corner of the container and extending between the container gables, said tube feeder means including a perforated drum and a worm conveyor located within the drum, said container and said tube feeder means cooperating so that when said first longitudinal corner of the container is positioned to be at substantially the vertically highest point of the container the tube feeder means can load said container with bulk product substantially evenly distributed in said container to substantially completely fill same, and when said first longitudinal corner is positioned to be at substantially the vertically lowest point of the container the tube feeder means can substantially evenly and substantially completely unload said container.

2. Container of claim 1, wherein said tube feeder means additionally includes drum driving means located in one gable of the container for rotating said drum, and worm conveyor driving means located in the opposite gable of the container for rotating the worm conveyor.

3. Container according to claim 2, wherein said drum is rotated in a first direction during container loading, and said worm conveyor is rotated in an opposite, second direction during container loading.

4. Container according to claim 3, wherein said drum is rotated in said second direction and said worm conveyor is rotated in said first direction during container unloading operation.

5. Container according to any one of claims 1, 2, 3 or 4, wherein connection means for feeding/discharging bulk material to/from said drum is located in a wall or gable of the container.

6. Container according to any one of claims 2, 3, or 4, wherein said driving means includes motors.

7. Container according to claim 6, wherein said motors are hydraulic motors.

* * * * *